US007382245B2

(12) United States Patent
Girouard

(10) Patent No.: US 7,382,245 B2
(45) Date of Patent: Jun. 3, 2008

(54) METHOD AND APPARATUS FOR INDICATING A POWER CONDITION AT A NOTIFICATION APPLIANCE

(75) Inventor: Gary R. Girouard, Ashburnham, MA (US)

(73) Assignee: SimplexGrinnell LP, Westminster, MA (US)

( * ) Notice: Subject to any disclaimer, the term of this patent is extended or adjusted under 35 U.S.C. 154(b) by 214 days.

(21) Appl. No.: 11/282,356

(22) Filed: Nov. 18, 2005

(65) Prior Publication Data

US 2007/0115111 A1 May 24, 2007

(51) Int. Cl.
*G08B 29/00* (2006.01)

(52) U.S. Cl. ..... 340/511; 340/514; 340/500; 340/506; 340/508; 340/660

(58) Field of Classification Search ..... 340/511
See application file for complete search history.

(56) References Cited

U.S. PATENT DOCUMENTS 4,470,047 A * 9/1984 Vogt et al. ..... 340/825.36
6,313,744 B1 11/2001 Capowski et al.
6,426,697 B1 * 7/2002 Capowski et al. ..... 340/506
2006/0214811 A1 * 9/2006 Barrieau et al. ..... 340/635

* cited by examiner

*Primary Examiner*—Donnie L. Crosland
(74) *Attorney, Agent, or Firm*—The Small Patent Law Group LLP

(57) ABSTRACT

A notification appliance and an alarm system are provided. The notification appliance comprises an alarm indicator and a control module, which is configured to perform notification applications by turning on/off the alarm indicator. The control module receives at least one of command instructions and notification signals, and directs the operation of the alarm indicator based on the command instructions and notification signals. The power condition of the notification appliance within the alarm system may be determined by comparing the notification signal and a predefined operating range for the notification signal. A fault indicator indicates a relationship between the notification signal and the predefined operating range.

20 Claims, 4 Drawing Sheets

METHOD AND APPARATUS FOR INDICATING A POWER CONDITION AT A NOTIFICATION APPLIANCE

BACKGROUND OF THE INVENTION

This invention relates generally to fire alarm systems, and more particularly, to methods and apparatus for indicating power conditions at notification appliances installed within fire alarm systems.

In general, alarm systems include several notification appliances that are joined to common power lines extending from a system controller. The power lines experience a voltage drop along the lines due to line resistance.

Notification appliances have one or more alarm indicators (i.e. strobes and horns) to notify people in the area of an alarm condition. Notification appliances include various electronic components that have certain power requirements. The notification appliances are generally powered by a remote power supply located, for example, in the system controller or some other remote site. Each notification appliance has a power operating range within which the device operates to provide the appropriate alarm indicators. A predefined or predetermined power (e.g., voltage and current) operating range may be set by a manufacturer or a regulatory body such as Underwriters Laboratories (UL). Different types of notification devices may have different voltage and/or current operating ranges.

Prior to installation, voltage drop calculations are obtained for the alarm system. The voltage drop calculations may be based on blueprints or other plans of the layout of the building and a lump sum calculation of voltage drop. However, the actual wire distances installed are typically different than as estimated, as the wire is run based on the actual physical building layout and obstacles. Therefore, estimating practices using the lump sum method of calculating voltage drops also add a margin of safety to the calculation. However, the margin of safety does not guarantee that the installed appliances are within the estimated distances of the system controller.

Therefore, after notification appliances are installed in a fire or other alarm system, the power, signal and/or voltage level at each of the notification appliances is verified to assure that the level of interest is within the desired range for operation. The verification is obtained by manually testing with a test meter a notification appliance circuit at each of the notification appliances. If the voltage level is outside the range (i.e. too high or too low) the notification appliance may not operate properly. Voltage that is below the operating range of the notification appliance can cause the appliance to produce visible signal intensities or sound pressure levels that are below the levels of the designed system. Also, voltage that is outside of the designed operating range may damage components, leading to premature failure. Depending upon the number of notification appliances installed, this manual testing process can be time consuming and adds significant labor cost to an installation. The voltage verification can also be disruptive, especially in buildings such as hospitals which do not typically have an unoccupied period during which testing can be performed.

In addition to testing the system upon installation, the system may need to be tested periodically, such as annually or semi-annually depending upon prevailing fire code and regulations, and the type of system and/or appliances and devices installed. System overloading may also occur after a system has been installed if devices are added to the system without verifying the system load capacity. This may cause the system to not function properly or experience premature failure as discussed above. Also, if the system is overloaded and already operating at a lower voltage level, the appliances may not operate as designed when the incoming AC power nears a brownout condition or after operating on battery power for a length of time.

Therefore, a need exists for an improved way to verify the power, signal and/or voltage levels at each notification device after installation and during an inspection. Additionally, a need exists for an improved way to verify that a system has not been overloaded by additional devices. Certain embodiments of the present invention are intended to meet these needs and other objectives that will become apparent from the description and drawings set forth below.

BRIEF DESCRIPTION OF THE INVENTION

In one embodiment, a notification appliance comprises an alarm indicator and a control module which is configured to perform notification applications by turning on/off the alarm indicator. The control module is configured to receive at least one of command instructions and notification signals, and directs operation of the alarm indicator based on the command instructions and notification signals. A fault indicator indicates a relationship between the notification signal and a predefined operating range for the notification signal.

In another embodiment, an alarm system comprises a system controller and a notification appliance. The notification appliance communicates with the system controller and includes an alarm indicator and a control module configured to turn on/off the alarm indicator. The control module is configured to receive at least one of command instructions and notification signals, and directs operation of the alarm indicator based on the command instructions and the notification signals. A fault indicator indicates a relationship between the notification signal and a predefined operating range for the notification signal.

In another embodiment, a method for testing an alarm system comprises sending at least one of command instructions and notification signals from a system controller to at least one control module, which is within at least one of a notification appliance and an end of line device. The command instructions indicate an operating range test. At least one control module receives the command instructions and notification signals and compares the notification signal to a predefined operating range. A fault indicator is set to indicate a relationship between the notification signal and the predefined operating range.

The foregoing summary, as well as the following detailed description of certain embodiments of the present invention, will be better understood when read in conjunction with the appended figures. It should be understood that the present invention is not limited to the arrangements and instrumentality shown in the attached figures. The figures illustrate diagrams of the functional blocks of various embodiments. The functional blocks are not necessarily indicative of the division between hardware circuitry. Thus, for example, one or more of the functional blocks (e.g., processors or memories) may be implemented in a single piece of hardware (e.g., a general purpose signal processor or a block or random access memory, hard disk, or the like). Similarly, the programs may be stand alone programs, may be incorporated as subroutines in an operating system, may be functions in an installed imaging software package, and the like.

DETAILED DESCRIPTION OF THE INVENTION

Figure 1:
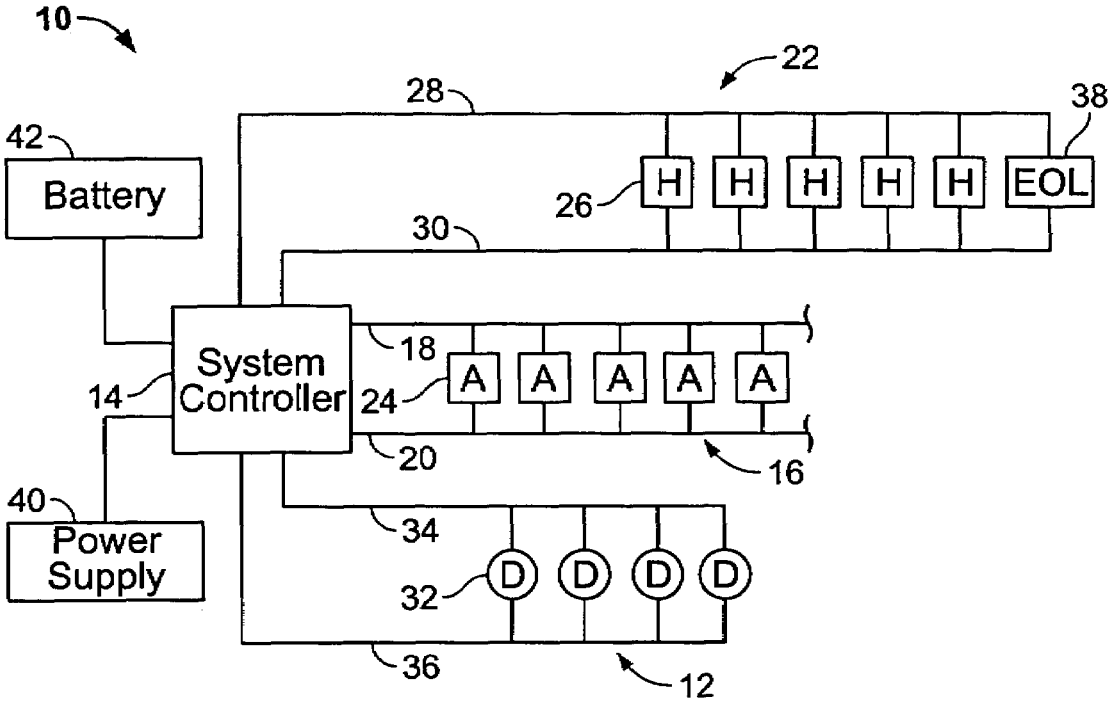
FIG. 1 illustrates an alarm system in accordance with an embodiment of the present invention.

FIG. 1 illustrates an alarm system 10 in accordance with an embodiment of the present invention. The system 10 includes one or more detector networks 12 having individual alarm condition detectors 32 which are monitored by a system controller 14. The detectors 32 may detect fire, smoke, temperature, chemical compositions, or other conditions. The alarm condition detectors 32 are coupled across a pair of power lines 34 and 36. When an alarm condition is sensed, the system controller 14 signals the alarm to the appropriate notification devices through one or more networks 16 of addressable alarm notification appliances 24 and/or one or more networks 22 of hardwired (e.g. non-addressable) alarm notification appliances 26. The networks 16 and 22 are also referred to as a notification appliance circuit (NAC).

The system controller 14 is connected to a power supply 40 which provides one or more levels of power to the system 10. One or more batteries 42 provide a back-up power source for a predetermined period of time in the event of a failure of the power supply 40 or other incoming power. Other functions of the system controller 14 includes showing the status of the system 10, control resetting a part or all of the system 10, silencing signals, turning off strobe lights, and the like.

The addressable notification appliances 24 are coupled to the system controller 14 across a pair of lines 18 and 20 that are configured to carry power and communications, such as command instructions. Supervision of the notification appliances 24 occurs by polling each notification appliance 24. Addressable notification appliances 24 each have a unique address and both send and receive communications to and from the system controller 14. The addressable notification appliances 24 may communicate their status and functional capability to the system controller 14 over the lines 18 and 20. The communication between the system controller 14 and the addressable notification appliances 24 may be accomplished in various ways, such as described in U.S. Pat. No. 6,313,744 (Capowski et al.), which is incorporated herein by reference in its entirety.

The hardwired notification appliances 26 are coupled with the system controller 14 across a pair of lines 28 and 30. A notification signal sent on the network 22 from the system controller 14 will be received by each hardwired notification appliance 26. An end of line (EOL) device 38 interconnects the ends of the lines 28 and 30 opposite the system controller 14. The EOL device 38 may be a resistor and/or provide voltage monitoring functions as discussed further below.

Two normal modes of operation within the system 10 are SUPERVISORY mode and ALARM mode. In the SUPERVISORY mode, the system controller 14 applies, for example, 8 to 9 VDC (a notification signal, power level, voltage level, and the like) to the networks 16 and 22. The positive signal may be applied to lines 18 and 30, for example. Therefore, enough power is provided to support two-way communications between the system controller 14 and the notification appliances 24 on network 16, and monitoring of the network 22 for integrity by the EOL device 38 and system controller 14. A diode or other component is used within the hardwired devices 26 to prevent voltage from powering the indicator circuits while in the SUPERVISORY mode.

In the ALARM mode, the system controller 14 applies, for example, a nominal 24 VDC (notification signal) to the networks 16 and 22 to supply power to operate the audible and visible indicator circuits of the notification appliances 24 and 26. The system controller 14 again applies the positive signal to line 18, but reverses the polarity on lines 28 and 30 so that the power to the audible and visible indicator circuits within the hardwired notification appliance 26 is no longer blocked by the diode. It should be understood that the voltages applied during each of the SUPERVISORY and ALARM modes may be different depending upon the type of notification appliance installed on each network and may be governed by applicable codes and governing bodies.

Figure 2:
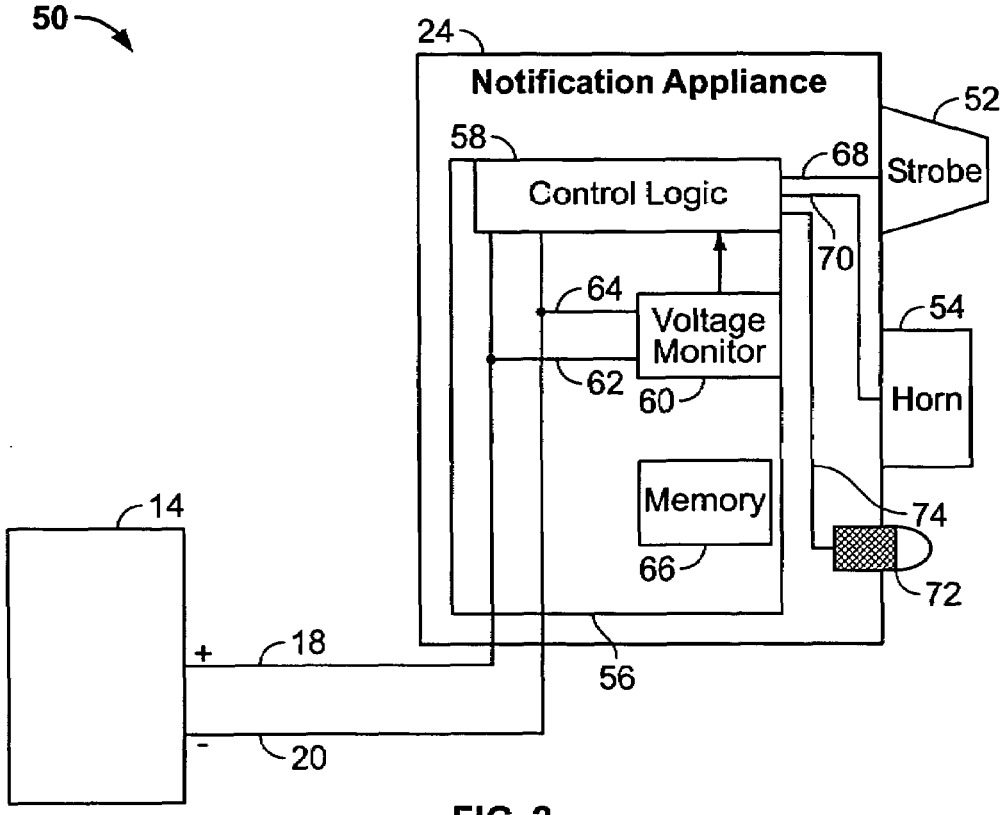
FIG. 2 illustrates an NAC of the alarm system with an addressable notification appliance having voltage monitoring capability in accordance with an embodiment of the present invention.

FIG. 2 illustrates an NAC 50 of the alarm system 10 with an addressable notification appliance 24 having voltage monitoring capability in accordance with an embodiment of the present invention. The addressable notification appliance 24 is interconnected with the system controller 14 as discussed previously. It should be understood that additional appliances and/or other devices may be installed on the NAC 50.

The notification appliance 24 has a control module 56 receiving command instructions and notification signals over the lines 18 and 20. The command instructions may, for example, be a signal indicating that the addressable notification appliance 24 should perform a desired test, power an alarm indicator, or return a status response. The control module 56 has control logic 58 that implements notification applications by processing the command instructions and initiating the desired action. An example of a notification application includes turning on/off alarm indicators.

One or more alarm indicators, such as strobe 52 and horn 54, are controlled by the control module 56 through lines 68 and 70, respectively. A fault indicator 72 is controlled by the control module 56 through line 74. The fault indicator 72 may be a single LED, multiple LEDs, one or more colored LEDs, a small display for displaying a number or alpha based code, and the like. The fault indicator 72 may also be a status indicator, such as an LED, which may communicate various information and states. For example, addressable notification appliances 24 may use the status indicator to indicate a fault, a circuit or component failure, or when testing the notification appliance 24, such as when conducting silent testing. One method is to operate the fault indicator 72 at a first rate to indicate that both the audible and visible indicators are being tested, and at second and third rates to indicate only the visible indicator or the audible indicator, respectively, are being tested. The different rates may instead constitute different on/off duty cycles or other patterns.

A voltage monitor 60 samples the lines 18 and 20 with lines 62 and 64 to read the notification signals. The voltage monitor 60 may compare the sampled voltage or signal to a predefined operating range or a voltage threshold. Based on the comparison, the control module 56 outputs an appropriate signal to the fault indicator 72. The predefined operating range or voltage threshold is determined by the type of the notification appliance 24, and may be stored in a memory 66 or be accomplished through other circuitry. The operating range or threshold may be set at the factory, during the installation of the system 10, modified based on changes to the system 10, and the like. Alternatively, a voltage sensitive trigger (not shown) within the control module 56 may be used to calibrate the operating range or threshold.

Figure 3:
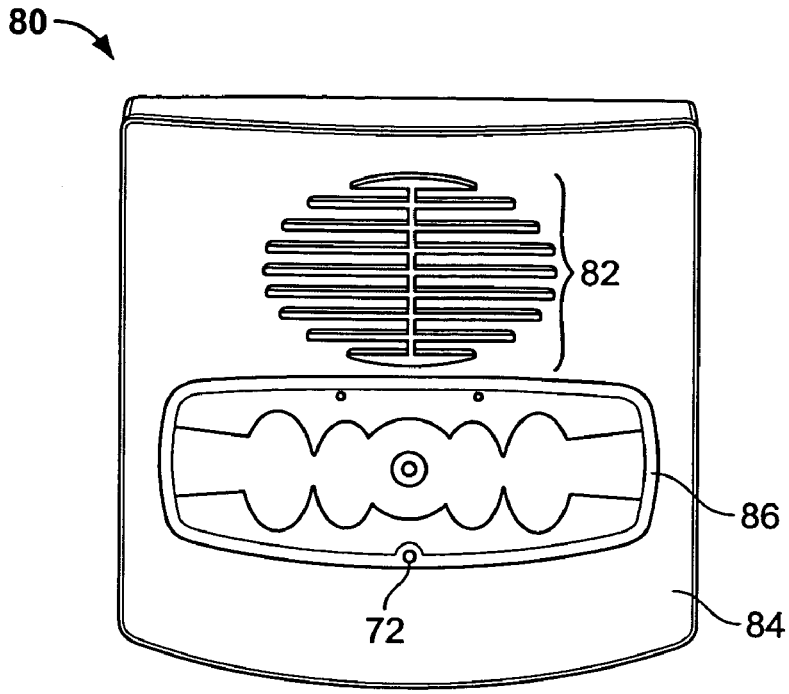
FIG. 3 illustrates a notification appliance in accordance with an embodiment of the present invention.

FIG. 3 illustrates a notification appliance 80 in accordance with an embodiment of the present invention. An outer cover 84 protects and obscures from view the control module 56 and other internal circuitry. Openings 82 in the outer cover 84 are placed in front of the horn 54. The outer cover 84 also has a lens 86 which is transparent or semi-transparent. The strobe 52 is placed behind the lens 86, and the fault indicator 72 is visible through the lens 86. Therefore, there is no need to remove the outer cover 84 when monitoring the fault indicator 72.

When the voltage monitor 60 (FIG. 2) samples the notification signals and compares the notification signals to the predefined operating range, the control module 56 may provide a first signal to the fault indicator 72 if the notification signal is within the operating range. To indicate a notification signal over or under the range, the control module 56 may provide a second and third signal, respectively, to the fault indicator. As the first, second and third signals are different, the relationship of the notification signal to the predefined operating range is easily determined by viewing the fault indicator 72 through the lens 86. Alternatively, no signal may be provided to the fault indicator 72 if the notification signal is within the operating range, and the fault indicator 72 will remain in an OFF condition.

Figure 4:
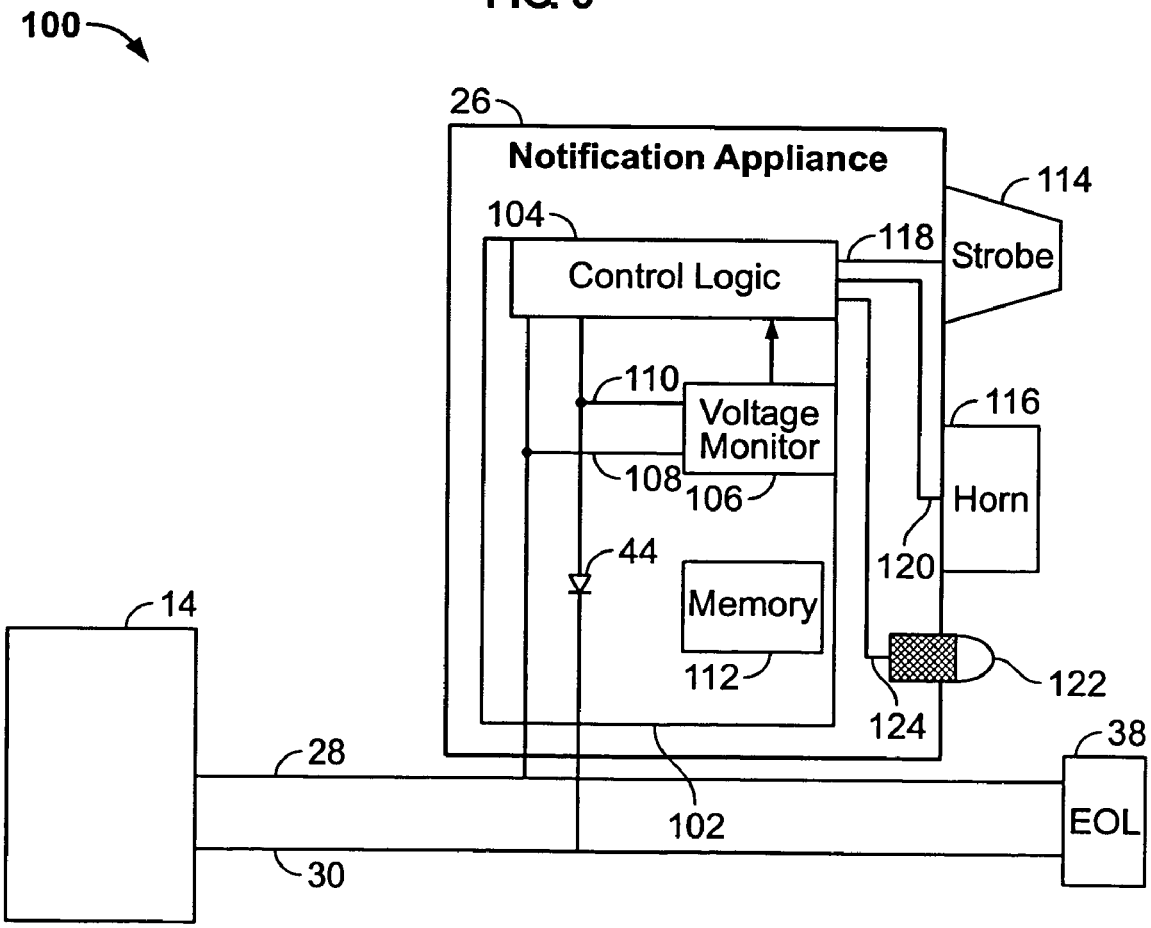
FIG. 4 illustrates an NAC of the alarm system with a hardwired notification appliance having voltage monitoring capability in accordance with an embodiment of the present invention.

FIG. 4 illustrates an NAC 100 of the alarm system 10 with a hardwired notification appliance 26 having voltage monitoring capability in accordance with an embodiment of the present invention. The hardwired notification appliance 26 is interconnected with the system controller 14 and EOL device 38 as discussed previously. Additional appliances and/or devices may be installed on the NAC 100. In SUPERVISORY mode, the system controller 14 may output a positive level on the line 30, which is blocked by diode 44 or other component from powering the indicator circuits. In ALARM mode, polarity is reversed and the positive level is output on line 28. The hardwired notification appliance 26 has a control module 102 receiving the notification signals over the lines 28 and 30 when in ALARM mode. The control module 102 has control logic 104 for initiating the desired action.

In ALARM mode, a voltage monitor 106 samples the lines 28 and 30 with lines 108 and 110 to read the notification signals. The voltage monitor 106 or control logic 104 conducts an operating range test by comparing the sampled voltage to a predefined operating range or a voltage threshold, determined by the type of the notification appliance 26, as discussed previously. The predefined operating range may be stored in a memory 112 or other circuitry, and may be set at the factory, during the installation of the system 10, and modified based on changes to the system 10.

The hardwired notification appliance 26 has one or more alarm indicators, such as strobe 114 and horn 116, which are controlled by the control module 102 through lines 118 and 120, respectively. A fault indicator 122 is controlled by the control module 102 through line 124. As discussed previously, the fault indicator 122 may be a single LED, multiple LEDs, one or more colored LEDs, a small display or other indicator.

Figure 5:
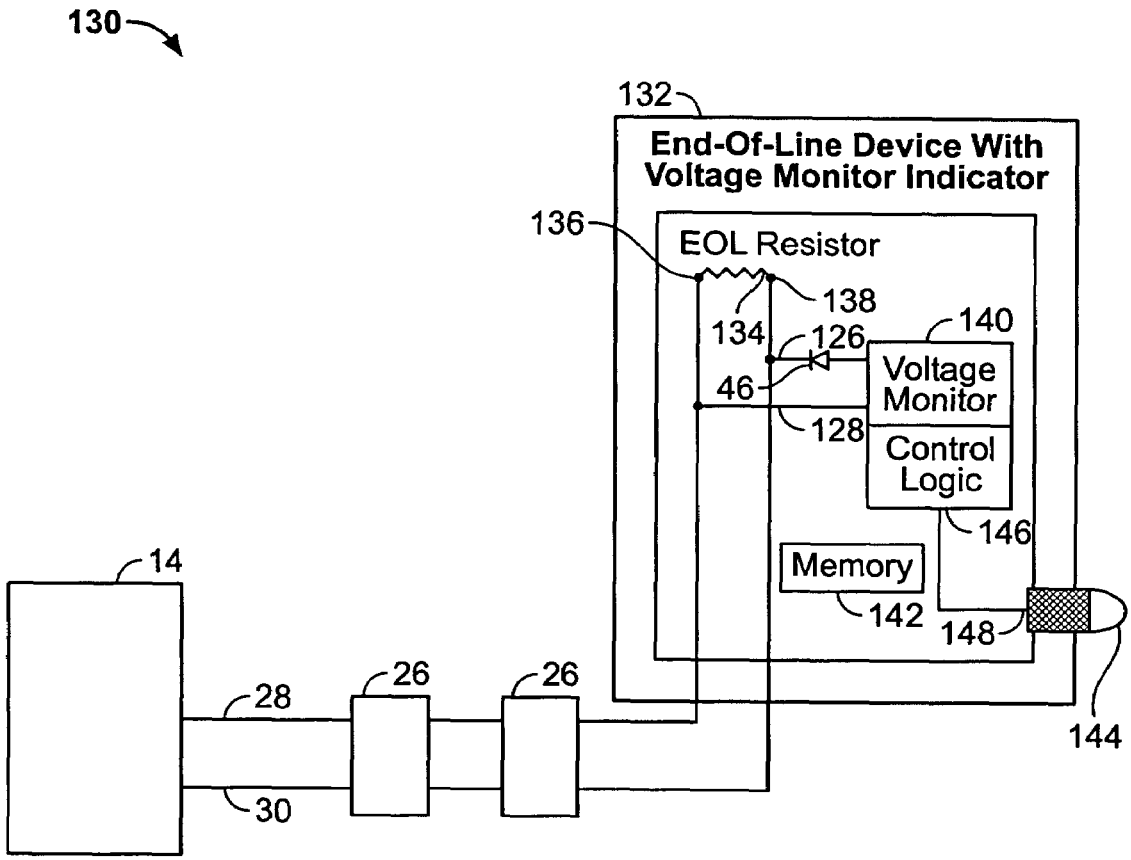
FIG. 5 illustrates an NAC of the fire alarm system with an EOL device having voltage monitoring capability in accordance with an embodiment of the present invention.

FIG. 5 illustrates an NAC 130 of the fire alarm system 10 with an EOL device 132 having voltage monitoring capability in accordance with an embodiment of the present invention. The EOL device 132 is interconnected with the system controller 14 and one or more hardwired notification appliances 26 as discussed previously. It should be understood that additional notification appliances 26 and/or other types of devices may be installed on the NAC 130.

The EOL device 132 has an EOL resistor 134 connected at first and second ends 136 and 138 to the end of the lines 28 and 30 opposite the system controller 14. Optionally, a diode 46 or other component may be used to block the power when the NAC 130 is operating in SUPERVISORY mode. In ALARM mode, a voltage monitor 140 samples the voltage level on the lines 28 and 30 with lines 126 and 128 to read the notification signals, or the voltage drop across the EOL resistor 134. The voltage monitor 140 or control logic 146 conducts an operating range test by comparing the sampled voltage to a predefined operating range or voltage threshold applicable to the installed hardwired notification appliance 26. The predefined operating range may be stored in a memory 142, and may be set at the factory, during the installation of the system 10, modified based on changes to the system 10, and the like.

The EOL device 132 has a fault indicator 144 which is controlled by control logic 146 through line 148. The fault indicator 144 provides a fault indication for the NAC 130 of the fire alarm system 10, and thus provides a fault indication for each hardwired notification device 26 connected on lines 28 and 30. The EOL device 132, with the voltage monitoring capability and the fault indicator 144, can be installed with notification appliances and/or other devices which have the same operating range. The EOL device 132 may be added to an existing installation to monitor circuit loading for voltage drop conditions. Thus, individual voltage monitoring is not added to each interconnected device. As discussed previously, the fault indicator 144 may be a single LED, multiple LEDs, one or more colored LEDs, a small display or other indicator. As with the addressable notification appliance 80 (FIG. 3), the fault indicator 144 is visible from outside the unit. Therefore, there is no need to remove an outer cover to view the status of the fault indicator 144.

The EOL device 132 may conduct the operating range test on a regular or semi-regular basis. Therefore, the control logic 146 may command the voltage monitor 140 to continuously sample the notification signals on lines 126 and 128 and compare the levels to the predefined operating range, for example, every one, five or ten minutes. The control logic 146 then outputs a first, second or third indication to the fault indicator 144 to indicate that the sampled signal is within, above, or below the range, respectively. The fault indicator 144 may continuously output the status, or may output the status for a predetermined time, such as 30 seconds or a minute, then remain in another state, such as OFF, until the operating range test is conducted again.

It should be understood that the functionality of the voltage monitor 60 and memory 66 (FIG. 2) may be integrated into the addressable notification device 24 and/or installed as an option on existing and/or already installed addressable notification devices 24. For example, the voltage monitoring capability may be added to an existing integrated circuit or provided on additional circuitry. Similarly, the voltage monitor 106, memory 112 and fault indicator 122 (FIG. 4) may be integrated into the hardwired notification device 26 and/or existing hardwired notification devices 26. Also, circuitry such as the voltage monitor 140, control logic 146, memory 142 and fault indicator 144 (FIG. 5) may be integrated into new, or added to existing, EOL devices 132.

Figure 6:
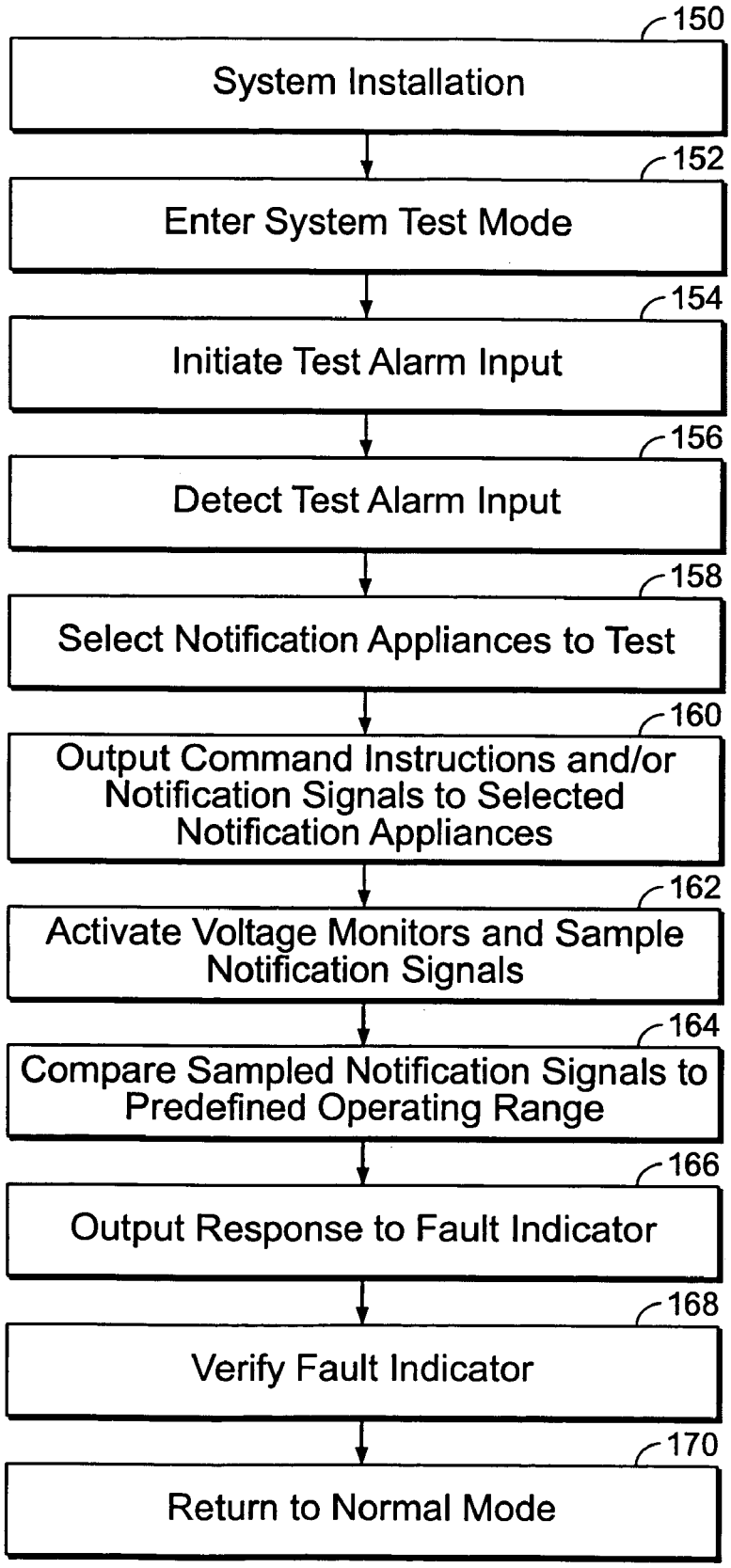
FIG. 6 illustrates a method for performing an operating range test in accordance with an embodiment of the present invention.

FIG. 6 illustrates a method for performing an operating range test in accordance with an embodiment of the present invention. The operating range test verifies that the notification signals, operating voltage and/or signal levels are within the desired operating range for each notification appliance 24 and 26, and allow a "silent test" of the appliances to be conducted without sounding the audible indicators or flashing the visible indicators.

At step 150, the notification appliances 24 and 26, the alarm condition detectors 32, and the system controller 14 are installed and programmed during system installation. Each of the alarm condition detectors 32 are associated with one or more of the notification appliances 24 and 26. When an alarm condition is detected by one of the alarm condition detectors 32, the system controller 14 notifies and/or supplies appropriate voltage to the associated notification appliances 24 and 26 which output the desired alarm condition.

At step 152, a SYSTEM TEST MODE is entered at the system controller 14. By way of example only, the SYSTEM TEST MODE may provide multiple system tests from which to choose, one of which being the operating range test. The SYSTEM TEST MODE may also provide a selection of tests to test and verify the programming of the system controller 14 and alarm condition detectors 32.

At step 154, an alarm input is initiated at one or more alarm condition detectors 32 (e.g., smoke detector, pull station). The alarm input may be simulated at the system controller 14. At step 156, the system controller 14 detects the alarm input, and at step 158, the system controller 14 identifies the one or more notification appliances 24 and 26 to be tested. The notification appliances 24 and 26 were associated with one or more of the alarm condition detectors 32 in step 150. Alternatively, a technician may manually select one, more than one, or all of the notification appliances 24 and 26 at the system controller 14 to be tested.

In step 160, the system controller 14 outputs command instructions and/or notification signals to the applicable notification appliances 24 and 26. For the addressable notification appliances 24, the system controller 14 outputs a command instruction addressed to each of the applicable addressable notification appliances 24, commanding the control module 56 to conduct the operating range test. For the hardwired notification appliances 26, the system controller 14 changes the polarity of power output on lines 28 and 30 of the network 22 (FIG. 1). For the EOL device 132, the operating range test may be conducted on a regular basis as discussed previously, and/or when polarity is reversed.

At step 162, the control module 56 receives the command instruction to conduct the operating range test and activate the voltage monitor 60 to sample the notification signals. The control module 102 receives positive power on line 28, which activates the voltage monitor 106. The control logic 146 may activate the voltage monitor 140 within the EOL device 132. In step 164, the voltage monitors 60, 106 and 140 and/or the control logic 58, 104 and 146 compare the sampled notification signals to a predefined operating range.

In step 166, the control logic 58, 104 and 146 outputs a signal to the fault indicator 72, 122 and 144 based on the result of step 164. The desired signal output for each condition may be stored in the memory 66, 112 and 142. A different signal output is created for each condition wherein the notification signal is less than, greater than, and within the predefined operating range.

For example, if the fault indicator 72 is a single LED, the response may be to pulse the fault indicator 72 at a slow rate to indicate that the notification signal is less than the predefined operating range, pulse the fault indicator 72 at a fast rate to indicate that the notification signal is greater than the predefined operating range, and provide one of a steady on or steady off condition to the fault indicator 72 to indicate that the notification signal is within the predefined operating range. Alternatively, if the fault indicator 72 comprises multiple LEDs, a code or pattern activating one or more LEDs to an ON or pulsing state may be used to indicate the status of the notification signal. If the fault indicator 72 is more than one colored LED, activating a particular color may signify the status of the notification signal, such as blue, red and green for below, greater than, and within the predefined operating range, respectively. Optionally, if the fault indicator 72 is a display, a particular number and/or letter combination may be displayed.

Optionally, the voltage monitor 60, 106 and 140 and control logic 58, 104 and 146 may be set to output two states, indicating that the notification signal is within or outside of the predefined operating range. Therefore, only two possible indications would be output.

At step 168, the status of the notification signal at every notification appliance 24 and 26 and EOL device 132 being tested is verified by visually checking the fault indicators 72, 122 and 144. There is no need to manually test the operating voltage level at each notification appliance 24 and 26 and EOL device 132 with a meter. The fault indicators 72, 122 and 144 are visible from outside of the outer cover 84 of the notification appliance 24 (and the outer cover of the EOL device 132, if present).

At step 170, the system controller 14 transmits a TEST MODE OFF message to the selected notification appliances 24 and reverses the polarity to the hardwired devices 26, returning the appliances 24 and 26 and/or EOL device 132 to a normal mode of operation. The system controller 14 may transmit the message after a predetermined test time interval or on a command input at the system controller 14. The system controller 14 may also send a lower level of notification signal, such as 8 to 9 VDC as previously discussed.

The operating range test may also be used when additional lights and/or devices are added to the system 10 after installation (step 150) to verify that the system 10 has adequate capacity. Too much load may cause one or more of the power supply 40, appliances 24 and 26, detectors 32 and battery 42 to experience premature failure and/or not operate to specification. Thus, adding a device to the system 10 which overloads the system 10 causes a fault condition. This may enable the overload on the system 10 to be corrected prior to failure of components or failure of the system 10 to operate correctly when needed. The operating range test of FIG. 6 provides the ability to verify the power or signal level at each of the appliances 24 and 26, or at the EOL device 132 for each NAC 130, in a quicker and less disruptive manner than manually testing the voltage level at each of the appliances 24 and 26 and EOL device 132.

For example, in response to a low voltage indication during an inspection, diagnostics may be performed to determine if the fault resides with the power supply 40, batteries 42, or if additional load has been added to the system 10 since the previous inspection, causing the system 10 to exceed its capacity. Also, as the fault indicators 72, 122 and 144 are visible from outside the device, the operation of the system 10 can be easily verified and demonstrated to authorities.

While the invention has been described in terms of various specific embodiments, those skilled in the art will recognize that the invention can be practiced with modification within the spirit and scope of the claims.

What is claimed is:

1. A notification appliance, comprising:

an alarm indicator;

a control module configured to perform notification applications by turning on/off the alarm indicator, the control module configured to receive command instructions and notification signals from a system controller located remote from the notification appliance, the control module directing operation of the alarm indicator based on the command instructions and the notification signals; and a fault indicator for indicating a relationship between the notification signal and a predefined operating range for the notification signal.

2. The notification appliance of claim 1, wherein the fault indicator includes at least one LED that turns on when the notification signal is outside of the predefined operating range.

3. The notification appliance of claim 1, wherein the predefined operating range constitutes a voltage threshold, the notification signal failing when the notification signal falls below the voltage threshold.

4. The notification appliance of claim 1, further comprising a voltage monitor comparing the notification signal to the predefined operating range, the fault indicator indicating a fault based on an output of the voltage monitor.

5. The notification appliance of claim 1, wherein the command instruction directs the control module to perform an operating range test to compare the notification signal and the operating range.

6. The notification appliance of claim 1, further comprising a memory storing the predefined operating range.

7. The notification appliance of claim 1, wherein the predefined operating range includes minimum and maximum voltages, between which the notification signal is valid.

8. The notification appliance of claim 1, wherein the control module is configured to operate in one of a hardwired and addressable manner with a system controller that is located remote from the notification appliance.

9. An alarm system, comprising:

a system controller outputting notification signals;

a notification appliance located remote from and communicating with the system controller, the notification appliance including an alarm indicator and a control module configured to turn on/off the alarm indicator, the control module configured to receive at least one of command instructions and notification signals, the control module directing operation of the alarm indicator based on the command instructions and the notification signals; and a fault indicator located within the notification appliance for indicating a relationship between the notification signal and a predefined operating range for the notification signal.

10. The alarm system of claim 9, wherein the fault indicator is provided in the notification appliance and an end-of-line device.

11. The alarm system of claim 9, wherein the fault indicator flashes at a first rate when the notification signal is lower than the predefined operating range and flashes at a second rate when the notification signal is higher than the predefined operating range, the first and second rates being different.

12. The alarm system of claim 9, the fault indicator further comprising:

a resistor interconnected with the system controller; and a second control module configured to receive command instructions and the notification signals, the second control module comparing the notification signal and the predefined operating range.

13. The alarm system of claim 9, wherein the fault indicator outputs a first output indicating a first relationship and a second output indicating a second relationship, the first and second relationships being greater than the predefined operating range and less than the predefined operating range, respectively.

14. A method for testing an alarm system, comprising:

sending command instructions and notification signals from a system controller to at least one control module located remote from the system controller, at least one control mod within at least one of a notification appliance and an end of line device, the command instructions indicating an operating range test;

receiving the command instructions and notification signals with at least one control module;

comparing the notification signal to a predefined operating range; and setting a fault indicator to indicate a relationship between the notification signal and the predefined operating range.

15. The method of claim 14, the setting step further comprising:

setting a first fault indication when the notification signal is within the predefined operating range;

setting a second fault indication when the notification signal is higher than the predefined operating range; and setting a third fault indication when the notification signal is lower than the predefined operating range, the first, second and third fault indications being different with respect to each other.

16. The method of claim 14, the setting step further comprising setting the fault indicator to one pulse at a first rate, pulse at a second rate different from the first rate, select one of multiple fault indicators, select one of multiple audible indicators, and flashing a code.

17. The method of claim 14, wherein the fault indicator indicating a fault condition for a notification appliance.

18. The method of claim 14, wherein the fault indicator indicating a fault condition for a subset of the alarm system.

19. The method of claim 14, wherein the fault indicator is visible beyond an outer shell of the notification appliance.

20. The method of claim 14, further comprising:

sending a fault indication from one of the notification appliances and the end of line device to the system controller based on the comparing step; and providing the fault indication at the system controller.

* * * * *

UNITED STATES PATENT AND TRADEMARK OFFICE

CERTIFICATE OF CORRECTION

PATENT NO. : 7,382,245 B2
APPLICATION NO. : 11/282356
DATED : June 3, 2008
INVENTOR(S) : Gary R. Girouard It is certified that error appears in the above-identified patent and that said Letters Patent is hereby corrected as shown below:

Column 10
Claim 14
Line 5
Change “control mod within” to --control module being within--

Column 10
Claim 14
Line 12
Change “setting a fault indicator to” to --setting a fault indicator located proximate to the at least one control module to--

Signed and Sealed this

Twenty-ninth Day of July, 2008

JON W. DUDAS
*Director of the United States Patent and Trademark Office*